United States Patent [19]

Lawlor et al.

[11] 4,001,921

[45] Jan. 11, 1977

[54] CABLE CLAMP WITH SIZE ADJUSTMENT

[75] Inventors: Robert E. Lawlor, Huntington Beach, Calif.; Paul A. Cornell, Headborough House, Ireland

[73] Assignee: Paul A. Cornell, Headborough House, Ireland

[22] Filed: Sept. 4, 1975

[21] Appl. No.: 610,418

[52] U.S. Cl. ..... 24/132 LS; 339/266 R

[51] Int. Cl.[2] ..... A44B 21/00; H01R 9/10

[58] Field of Search ..... 339/266 R, 270 R, 274, 339/95 R; 24/132 LS, 134 R, 132 AC, 132 AB, 134 L

[56] References Cited

UNITED STATES PATENTS

| | | | |
|---|---|---|---|
| 2,287,490 | 6/1942 | Tenney | 339/266 R X |
| 3,169,818 | 2/1965 | Tracy | 339/266 R |
| 3,801,952 | 4/1974 | Lawlor | 339/266 R |
| 3,861,771 | 1/1975 | Cornell | 339/266 R X |
| 3,879,104 | 4/1975 | Shugarman et al. | 339/266 R |

*Primary Examiner*—Donald A. Griffin
*Attorney, Agent, or Firm*—Hume, Clement, Brinks, Willian, Olds & Cook, Ltd.

[57] ABSTRACT

A cable connector of the clamp type having a female member with a C-shaped sleeve and a tail, and a male member with a cylindrical head and a tail, with cable receiving bores in the head and sleeve and with the members arranged so that movement of the tails toward one another effects clamping of the cable, is particularly characterized by its ability to clamp cables of different diameters. The members are constructed to minimize the cable insertion angle so as to permit insertion of larger diameter cables without interference with the body upon which the connector is mounted, and still permit clamping of smaller diameter cables. An index or a stop serves to position the tails at a predetermined angular spacing to control the clamping force.

12 Claims, 8 Drawing Figures

CABLE CLAMP WITH SIZE ADJUSTMENT

BACKGROUND OF THE INVENTION

Cable connectors of the clamping type, especially useful as electrical connectors and also useful for effecting mechanical cable connections, are known in the art as disclosed in Schuck et al. U.S. Pat. No. 3,118,720. Such a clamp comprises, in general, a female member having a C-shaped sleeve and a male member having a cylindrical head for relative rotatable movement within the sleeve. The sleeve and head have respective diametrical bores which, in the open position of the connector, are axially aligned to receive a cable (such as an electrical conductor). The male and female members have generally coextensive tails which, when secured together, cause the internal surfaces of the bores to exert a clamping force on the cable. The connector is adapted to be mounted upon a planar body or other mounting surface.

Such connectors are typically designed for use with only a single size cable. In many applications, however, it is desirable to have a single connector which is adapted for use with cables of different diameters. One such design for connectors of a somewhat similar type is shown in Beaudion U.S. Pat. No. 3,437,979. That design, however, is not suitable for use with connectors of the type contemplated by the present invention.

In attempting to use connectors of this type to clamp cables of different diameters, conflicting considerations arise. A first consideration is the need to keep the cable insertion angle (i.e., the angle formed by the intersection of the axis of the bores with the body upon which the connector is mounted) to a minimum so as to permit insertion of large diameter cables without interference from the mounting surface. A second consideration is to provide for sufficient angular rotation between the male and female members to effect clamping of smaller diameter cables. Recognition of these conflicting considerations is a significant aspect of the concept of the present invention.

SUMMARY OF THE INVENTION

The present invention provides a cable connector wherein the cable insertion angle is minimized without impairing the ability of the connector to clamp smaller diameter cables. This is achieved by constructing the male and female members in such a manner that, when the connector is in its fully closed position, the axis of the bore of the female member goes beyond horizontal to form a negative acute angle with the planar surface upon which the connector is mounted. This permits a sufficient degree of angular rotation between male and female members to permit full clamping of smaller sized cables without increasing the cable insertion angle. In addition, positioning means, such as an index or a stop, are provided to achieve a preselected angular spacing between the tails of the male and female members, thus controlling the degree of closure of the connector and the resultant clamping force upon the cable.

The general object of this invention is to provide a clamp type cable connector which will accommodate cables of different diameter. Other objects will become apparent upon consideration of the following description, with reference to the appended drawings, in which.

DESCRIPTION

With reference to the drawings, there is shown in FIGS. 1–5 and 8 thereof, as an example of one form in which the present invention may be embodied, a clamp type cable connector comprising, in general, male and female members 10 and 12, respectively, each having a tail, 14 and 16, respectively. The connector is adapted to be mounted upon a planar body or mounting surface 18.

Figure 1:
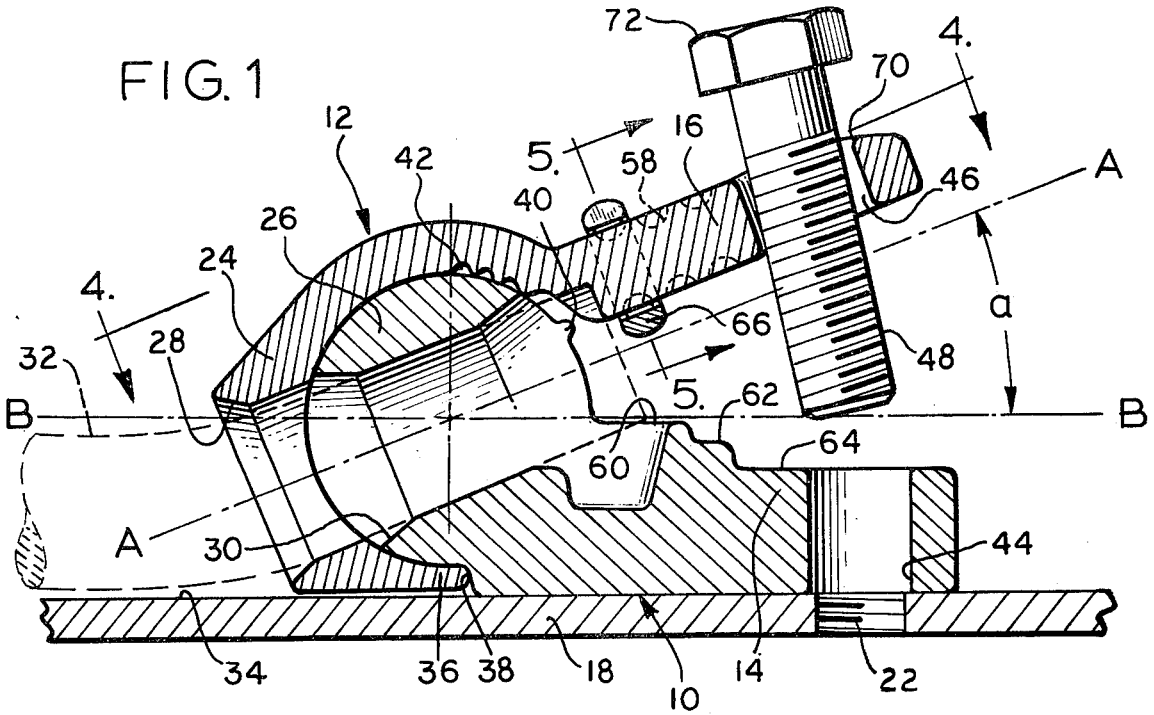
FIG. 1 is a cross-sectional view of a connector embodying the invention, shown in the fully open position with a larger diameter cable inserted therein.

It should be understood that all reference herein to angles and directions are on the basis of the connector being oriented as shown in FIG. 1; i.e., with the mounting body 18 in a horizontal position and with the connector mounted on the top side of the body with the tails 14 and 16 extending to the right. In this orientation, the plane of the upper surface of the mounting body 18 will be taken to be the reference (i.e., at 0°) with angular displacement in a counterclockwise direction therefrom taken as positive and rotation in a clockwise direction taken as negative. It should be understood that this orientation, of course, is for purposes only of this description and the appended claims, and that the body 18 and the mounting of the connector thereon may be at any desired orientation.

As shown in FIG. 1, the female member 12 includes a generally C-shaped sleeve 24 adapted to mate with a generally cylindrical head 26 on the male member 10. The sleeve 24 of the female member 12 includes a generally diametrical bore 28. The head 26 of the male member 10 includes a similar bore 30. The bores 28 and 30 are preferably formed with a X-shaped cross-section as shown in Lawlor U.S. Pat. No. 3,406,372.

The connector, as it is shown in FIG. 1, is in its fully open position for receiving a cable 32. The cable 32 is arbitrarily selected for purposes of this description to be of 4/0 size. As can be seen in FIG. 1, when the connector is fully open for insertion of the cable 32, the bores 28 and 30 are in generally co-axial alignment, with the axis of the bore 28 being represented by the line A—A. A line parallel to the upper surface of the mounting body 18 is represented by the line B-B.

The angle formed by the intersection of lines A—A and B—B, the "insertion angle", *a*, is significant. If the insertion angle *a* is too large, it will be difficult or impossible to insert a cable of larger diameter into the connector, due to interference with the upper surface of the mounting body 18 at point 34. As can be seen, the cable 32 must be bent in order to achieve clearance for insertion into the connector. It has been found that the positive acute insertion angle *a* must be maintained at less than about 30° and, preferably at less than about 18°, with larger diameter cables.

Figure 8:
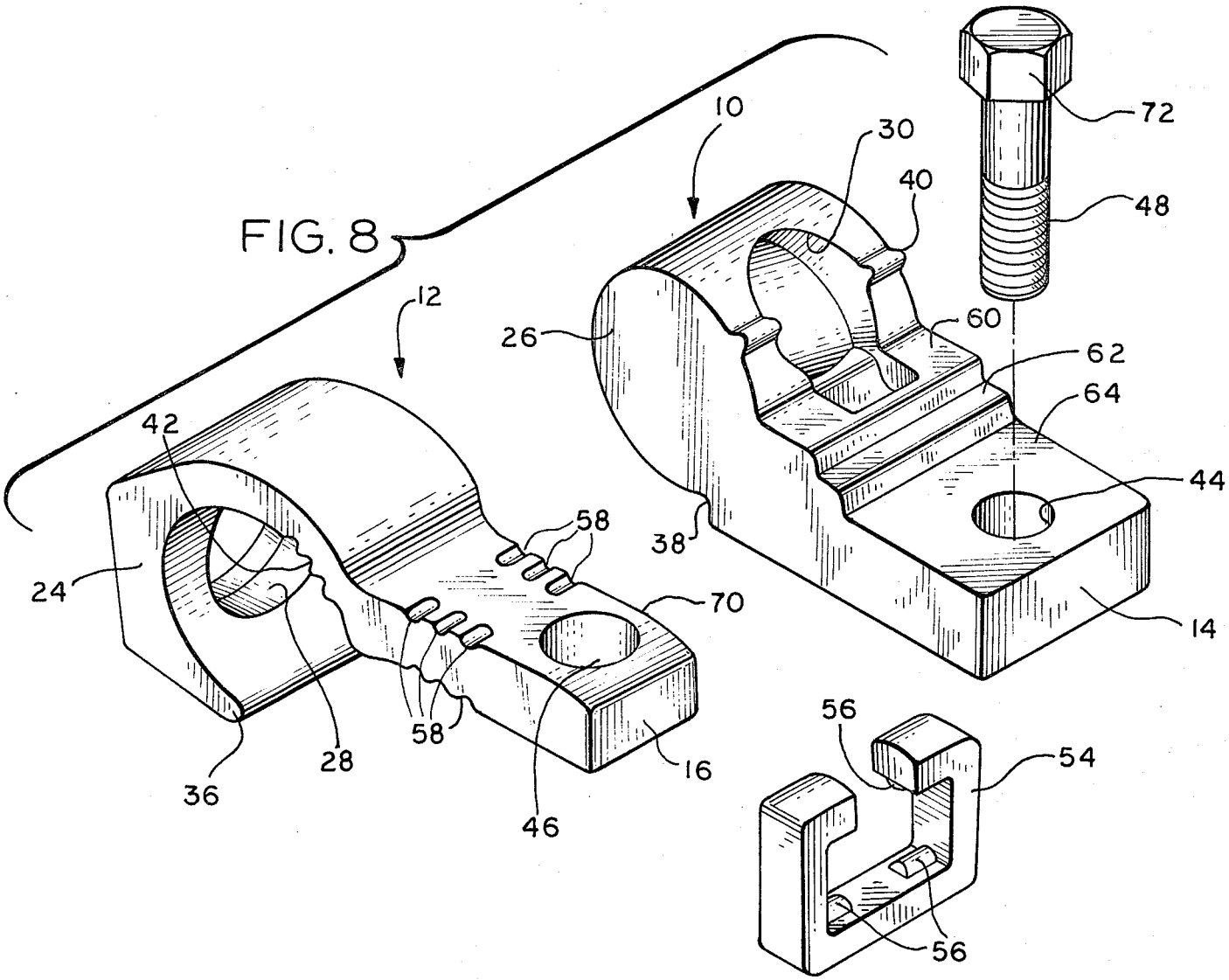
FIG. 8 is an exploded perspective view of the connector of FIG. 1.

The interrelationship of the male member 10 and the female member 12 can best be appreciated by considering FIG. 8 in conjunction with FIG. 1. As can be seen from FIG. 8, the generally cylindrical head 26 of the male member 10 is adapted for relative rotation within the C-shaped sleeve 24 of the female member 12. The female member 12 is prevented from over-rotation in a counterclockwise direction beyond the fully open position of the connector by the free end 36 of the sleeve which will make contact at point 38 on the male member and serve as a stop for rotation in the counterclockwise direction. The male member 10 also includes one or more teeth 40 on the head portion 26, adapted to mate with corresponding notches 42 on the interior surface of the sleeve 24. These notches provide a lock for the connector as described in Lawlor U.S. Pat. No. 3,801,952.

As can be seen from FIG. 1, the tail 14 of the male member 10 has an unthreaded aperture 44. Similarly, the tail 16 of the female member 12 has an unthreaded aperture 46. The apertures are arranged so as to be in substantially co-axial alignment when the tails 14 and 16 are moved toward one another to the closed position of the connector. A screw or bolt 48 passes through the apertures 46 and 44 into a suitably threaded aperture 22 in the body 18. The screw 48 serves as a closure means to maintain the tails 14 and 16 in a fixed angular position and thus to maintain the degree of closure of the connector.

Figure 2:
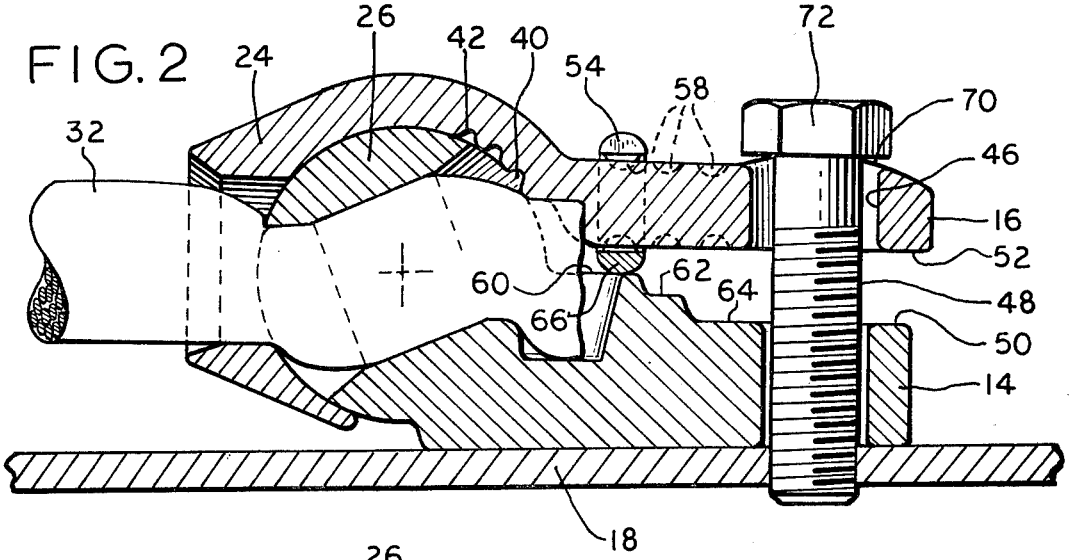
FIG. 2 is a cross-sectional view of the same, shown in closed position for clamping the larger diameter cable.

In order to clamp a cable in the connector, the cable 32 is inserted as shown in FIG. 1. The tails 14 and 16 are then moved relatively toward one another, causing relative rotation of the sleeve 24 and the head 26. Clamping is effected by the interior surfaces of the bores 28 and 30. FIG. 2 shows the 4/0 size cable 32 in clamped position. It will be noted that the screw 48 is engaged with the threaded aperture 22, thus providing a constant closure pressure on the tails 14 and 16 and a resultant clamping force on the cable 32.

It will be noted in FIG. 2, that there is still a fairly large gap between he distal ends 50 and 52 of the respective tails 14 and 16. In other words, but for the provision of a stop, an index, or some other means of achieving a predetermined spacing between the tails 14 and 16, the tails could be brought closer together by further tightening of the bolt 48. This could result in an increased clamping force on the cable 32 which could damage either the cable, the connector or both. Accordingly, a stop member 54 is provided in association with the tail 16. As can be best seen from the FIGS. 4 and 5, the stop member 54 is a generally C-shaped member adapted for sliding movement along the tail 16. The stop member 54 is provided with tabs 56 which are designed to mate with corresponding grooves 58 in the tail member 16. Thus the stop member 54 may be moved along the tail 16 to predetermined locations. The tail 14 of the male member has its upper surface formed into steps, which provide stop surfaces 60, 62 and 64.

The stop member 54, and in particular the lower surface 66 thereof, cooperates with the steps or stop areas 60, 62 and 64 to provide means for positioning the tails 14 and 16 at three predetermined angular spacings, thus controlling in three steps the degree of closure of the connector. For example, in FIG. 2, the stop member 54 is positioned so that its tabs 56 interact with the set of grooves 58 closest to the sleeve 24. Thus the bottom surface 66 of the stop member 54 is positioned to interact with the first step or stop area 60. The height of the stop area 60 is preselected to achieve a proper degree of closure of the connector for the 4/0 cable 32. Thus, when the bolt 48 is tightened down to the point where the stop member 54 contacts the stop area 60, the proper amount of clamping force will be exerted on the 4/0 cable 32.

Figure 3:
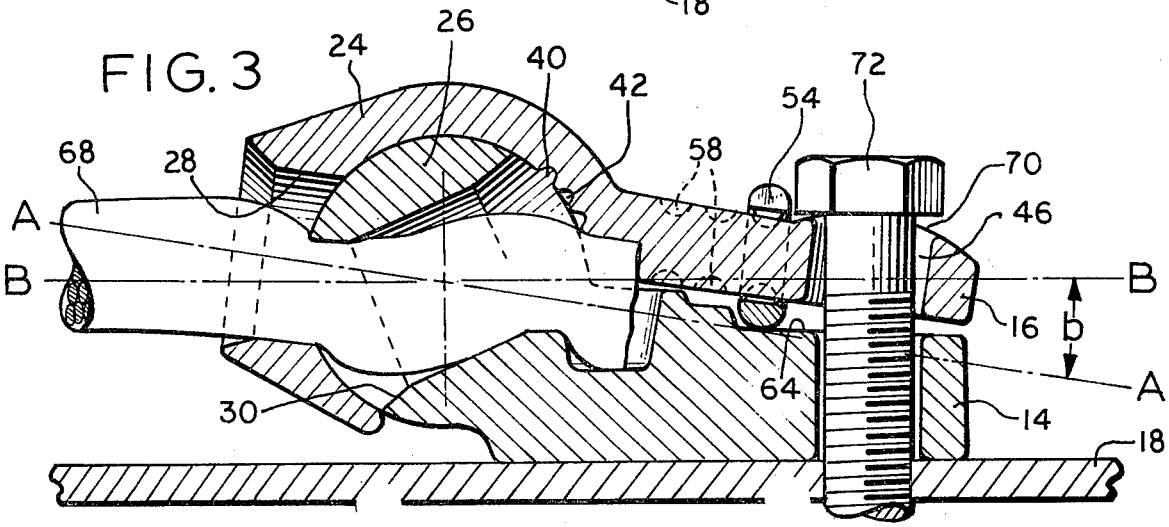
FIG. 3 is a cross-sectional view of the same, shown in fully closed position for clamping a smaller diameter cable.
Figure 4:
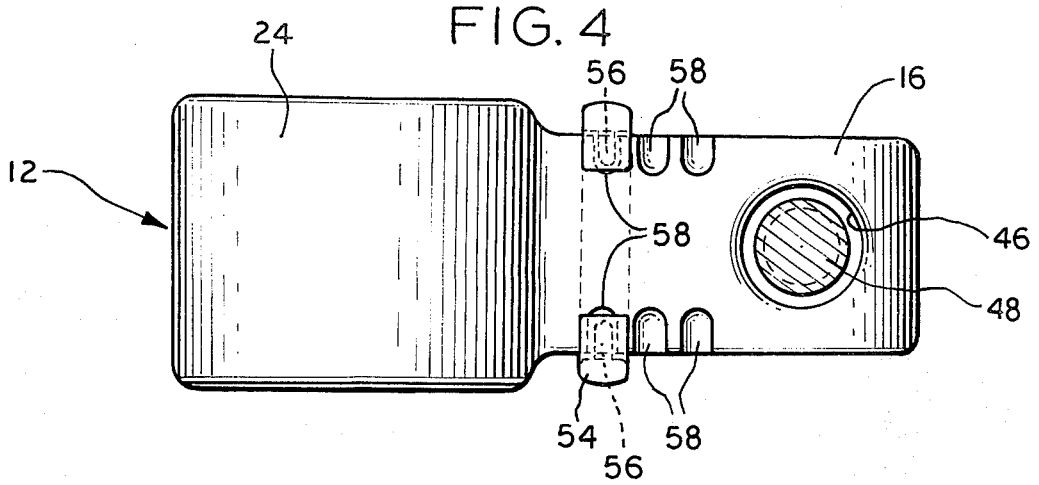
FIG. 4 is a top view of the same, taken on the line 4—4 in FIG. 1.
Figure 5:
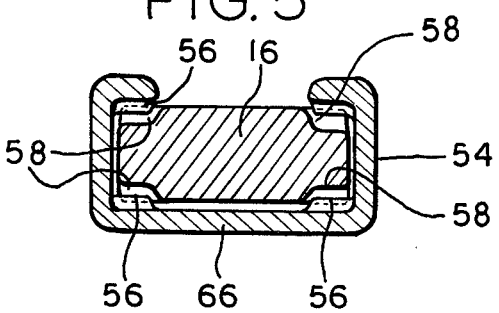
FIG. 5 is a transverse sectional view of a portion of the same, taken on the line 5—5 of FIG. 1.

FIG. 3 shows the connector in its fully closed position with a 2/0 cable 68 in place. With a cable of this size, the stop member 54 is moved to the groove 58 which is closest to the distal end of the tail 16 and the stop member 54 is thus positioned to interact with the lowest stop area 64. Again, the height of the stop area 64 is preselected to achieve a predetermined angular spacing between the tails 14 and 16 and thus control the degree of closure of the connector and exert the appropriate amount of clamping force on the 2/0 cable 68.

It will be noted that the upper surface 70 of the tail 16, in the vicinity of the aperture 46, is curved. This curvature provides a horizontal bearing surface for the underside of the head 72 of the bolt 48 regardless of the degree of closure of the connector.

As can be seen in FIG. 3, the line B—B again represents a line parallel to the upper surface of the mounting body 18, and the line A—A represents the axis of the bore 28. With the sleeve 24 rotated to the fully closed position of the connector as shown in FIG. 3 with a 2/0 cable 68 clamped in place, the angle *b* formed by the intersection of lines A—A and B—B is a negative acute angle. In prior art connectors of the type shown in Schuck U.S. Pat. No. 3,118,720, this angle, when the connector is fully closed, is generally zero. Inasmuch as the prior art connectors are designed only for a single cable diameter, this presents no problem, inasmuch as the insertion angle *a* can be kept acceptably small and satisfactory clamping force can be achieved simply by rotating the tails through an angular displacement approximately equal to the insertion angle *a*. Inasmuch as the bores of the prior art connectors are sized to receive the single diameter cable with only slight clearance, the required clamping force can be achieved with a smaller angular displacement. Any attempt to use the prior art connector with a smaller diameter cable, however, would be ineffective, because the diameter of the bores would then be significantly larger than the cable and it would be impossible to exert sufficient clamping force on a smaller cable in rotating to the fully closed position of the connector. As long as the angle *b* is near zero (or positive) the only practicable way to adapt the prior art connector so that it would exert sufficient force to clamp a cable of diameter significantly less than the diameter of the bores would be to increase the insertion angle. But this, as mentioned previously, is undesirable, since an increase in the insertion angle beyond certain limits renders it impossible to insert the cable. (It would, of course, be possible to provide more clearance for a given insertion angle by raising the center of rotation of the connector assembly higher above the mounting body, as by a shim or increased thickness of the male tail; but this increases both size and cost of the connector.) Accordingly, the present invention employes male and female members of a construction which permits the angle *b* to be negative, thus permitting a sufficient degree of relative rotation between the sleeve 24 and the head 26 to achieve the required clamping force for a small diameter cable, without increasing the insertion angle. In other words, the present invention contemplates a construction which permits the sleeve 24 to rotate through an angle greater than the insertion angle.

Figure 7:
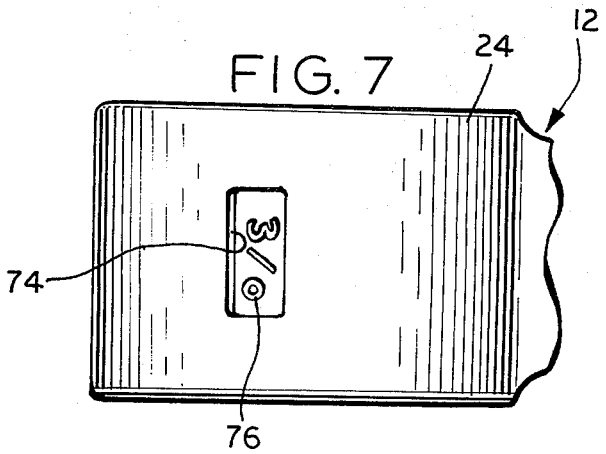
FIG. 7 is a partial top view of the same, taken on the line 7—7 in FIG. 6.
Figure 6:
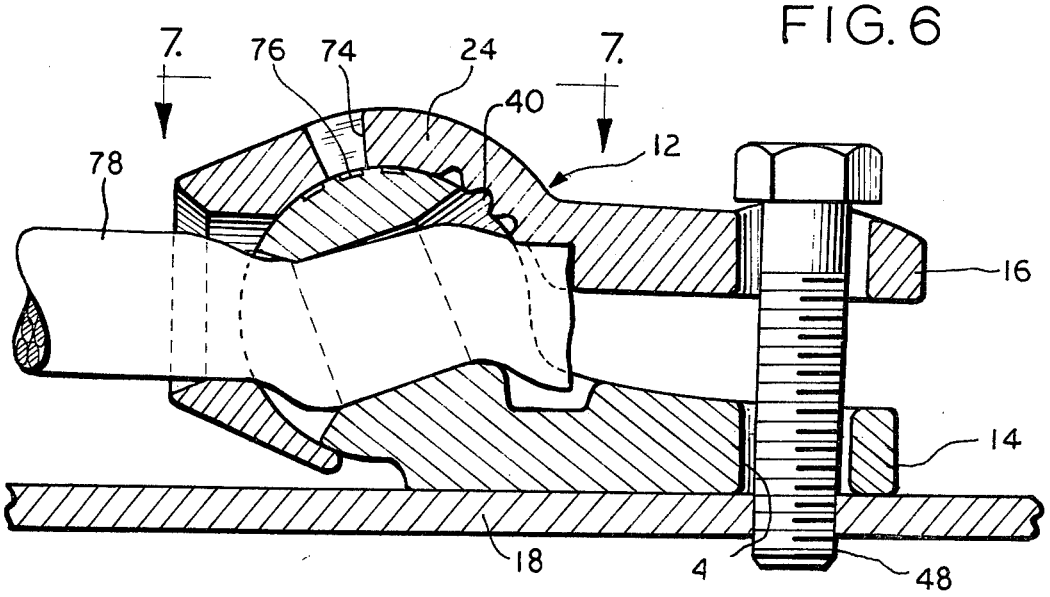
FIG. 6 is a cross-sectional view of a modified form of cable connector embodying the present invention, shown in the closed position for clamping a cable of medium diameter.

FIGS. 6 and 7 show a modified connector, also embodying the invention, with an alternative positioning means. As shown therein, the sleeve 24 of the female member 16 includes a viewing aperture 74 which permits visual access to the upper surface of the head 26. Inscribed on the head are indicia 76 representing cable diameters. Thus, in order to achieve the appropriate degree of closure of the connector for clamping, for example, a size 3/0 connector 78, the tails are moved toward one another until the indicia "3/0" is visible through the aperture 74. The operator will then know that a proper clamping force for a 3/0 size cable is being exerted on the cable 78.

Alternatively, an index system could be inscribed on the sides of the sleeve 24 and head 26.

It will be noted that, in the embodiment of FIG. 6, the connector is again mounted to the body 18 by means of the screw 48, which serves both to mount the connector on the body 18 and as the closure means for maintaining the tails 14 and 16 in fixed angular position to maintain the degree of closure of the connector. It should be understood that other mounting means may be employed. For example, a separate screw (not shown) could pass through a suitable aperture in the tail 14 and into a threaded aperture in the body 18 to hold the connector rigidly in place. Alternatively, the aperture 44 could be threaded for the screw 48, with the aperture 22 unthreaded, and a separate nut (not shown) could be used in conjunction with the screw 48 to hold the connector firmly in place on the body 18. As can be seen, any suitable mounting means may be employed, either separately, or serving also as the closure means.

Again, it should be emphasized, as explained above, that the use of the term "positive" and "negative" angles refers to the particular arbitrary orientation of the connectors in the appended drawings. Any orientation may be used, as desired. The critical factor of the invention is keeping the insertion angle *a* (i.e., the angle between the bore 28 in the female member 12 and the plane of the mounting body 18) as small as possible while still permitting sufficient relative rotation between the head 26 of the male member 10 and the sleeve 24 of the female member 12 to achieve sufficient clamping force for smaller diameter cables. In some cases, as for example with only two sizes of cable, it may be possible to achieve this by permitting the angle *b* between the axis of the bore 28 in the female sleeve 24 and the plane of the mounting body 18 to be zero or even positive in the fully closed position of the connector. In order to accommodate a wider range of cable diameters, however, it is usually necessary to construct the female and male members so that such angle is negative.

We claim:

1. A clamp type cable connector comprising:

a male member including a tail having a planar bottom surface for mounting said connector on a planar body; and a generally cylindrical head at one end of said tail, said head having a bore for receiving a cable;

a female member including a tail; and a generally C-shaped sleeve at one end of said tail, said sleeve having a bore for receiving said cable;

said sleeve being adapted to receive said head for rotatable movement between open and closed positions of said connector as said tails are moved apart or together, said bores being in generally axial registry when said tails are spaced apart in the fully open position of said connector, with the internal surfaces of said bores serving to clamp said cable upon relative rotation of said sleeve and head as said tails are moved together to close said connector; and wherein the angle of the axis of the bore in said sleeve with the plane of said bottom surface when said connector is fully open is sufficiently small to permit insertion of a cable nearly as large in diameter as the diameter of said bore, and means for rotating said sleeve relative to said head between fully open and closed positions of said connector sufficiently to provide adequate clamping force on a cable of substantially smaller diameter than the diameter of said bore.

2. A clamp type cable connector comprising:

a male member including a tail having a planar bottom surface for mounting said connector on a planar body; and a generally cylindrical head at one end of said tail, said head having a bore for receiving a cable;

a female member including a tail; and a generally C-shaped sleeve at one end of said tail, said sleeve having a bore for receiving said cable;

said sleeve being adapted to receive said head for rotatable movement between open and closed positions of said connector as said tails are moved apart or together, said bores being in generally axial registry when said tails are spaced apart in the fully open position of said connector, with the internal surfaces of said bores serving to clamp said cable upon relative rotation of said sleeve and head as said tails are moved together to close said connector;

wherein the axis of the bore in said sleeve forms a negative acute angle with the plane of said bottom surface when said connector is fully closed.

3. A connector as defined in claim 2, including closure means for maintaining said tails in fixed angular position to maintain the degree of closure of said connector.

4. A connector as defined in claim 3, including means for positioning said tails at more than one predetermined angular spacing to control the degree of closure of said connector.

5. A connector as defined in claim 4, wherein said positioning means comprises an index for visually indicating the degree of relative rotation of said sleeve and head.

6. A connector as defined in claim 4, wherein said positioning means comprises a stop member associated with one of said tails and movable therealong to positions preselected to register said stop member with corresponding stop areas on the other of said tails, said stop areas being arranged so that movement of said stop member toward the distal end of said one tail permits an increasing degree of closure of said connector.

7. A connector as defined in claim 2, wherein the axis of the bore in said head forms a positive acute angle of less than 30° with the plane of said bottom surface.

8. A clamp type cable connector comprising:

a male member including a tail having a planar bottom surface for mounting said connector on a planar body; and a generally cylindrical head at one end of said tail, said head having a bore for receiving a cable;

a female member including a tail; and a generally C-shaped sleeve at one end of said tail, said sleeve having a bore for receiving said cable;

said sleeve being adapted to receive said head for rotatable movement between open and closed positions of said connector as said tails are moved apart or together, said bores being in generally axial registry when said tails are spaced apart in the fully open position of said connector, with the internal surfaces of said bores serving to clamp said cable upon relative rotation of said sleeve and head as said tails are moved together to close said connector;

and means for positioning said tails at more than one predetermined angular spacing so as to achieve a predetermined degree of closure of said connector and a resultant predetermined clamping force for more than one size of cable.

9. A connector as defined in claim 8, wherein said positioning means comprises an index for visually indicating the degree of relative rotation of said sleeve and head.

10. A connector as defined in claim 8, wherein said positioning means comprises a stop member associated with one of said tails and movable therealong to positions preselected to register said stop member with corresponding stop areas on the other of said tails, said stop areas being arranged so that movement of said stop member toward the distal end of said one tail permits an increasing degree of closure of said connector.

11. A connector as defined in claim 8, wherein the axis of the bore in said head forms a positive acute angle of less than 30° with the plane of said bottom surface.

12. A clamp type cable connector comprising:

a male member including a tail having a planar bottom surface for mounting said connector on a planar body; and a generally cylindrical head at one end of said tail, said head having a bore for receiving a cable;

a female member including a tail; and a generally C-shaped sleeve at one end of said tail, said sleeve having a bore for receiving said cable;

said sleeve being adapted to receive said head for rotatable movement between open and closed positions of said connector as said tails are moved apart or together, said bores being in generally axial registry when said tails are spaced apart in the fully open position of said connector, with the internal surfaces of said bores serving to clamp said cable upon relative rotation of said sleeve and head as said tails are moved together to close said connector; and means for rotating said sleeve relative to said head between fully open and closed positions of said connector through an angle greater than the angle of the axis of the bore in said sleeve with the plane of said bottom surface when said connector is fully open.

* * * * *